US007153098B2

(12) United States Patent
Zabawa

(10) Patent No.: US 7,153,098 B2
(45) Date of Patent: Dec. 26, 2006

(54) ATTACHMENT FOR A BLADED ROTOR

(75) Inventor: Douglas J. Zabawa, Bondsville, MA (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/814,066

(22) Filed: Mar. 31, 2004

(65) Prior Publication Data

US 2004/0184919 A1 Sep. 23, 2004

Related U.S. Application Data

(63) Continuation of application No. 10/123,453, filed on Apr. 16, 2002, now Pat. No. 6,846,159.

(51) Int. Cl.
*F01D 21/00* (2006.01)

(52) U.S. Cl. ..... 416/2; 416/220 R; 416/223 R

(58) Field of Classification Search ..... 416/2, 416/193 A, 220 R, 221, 223 R
See application file for complete search history.

(56) References Cited

U.S. PATENT DOCUMENTS 2,847,187 A 8/1958 Murphy
4,050,134 A 9/1977 Warner et al.
4,102,602 A 7/1978 Rottenkolber
4,417,854 A * 11/1983 Cain et al. ..... 416/241 B
4,453,890 A 6/1984 Brantley
4,480,957 A 11/1984 Patel et al.
6,065,938 A 5/2000 Bartsch

FOREIGN PATENT DOCUMENTS

DE 197 05 323 A1 8/1998
EP 0 874 136 A 10/1998
GB 790 350 A 2/1958
GB 894 704 A 4/1962

OTHER PUBLICATIONS

European Search Report for EP 1 355 044, Jul. 15, 2005.

* cited by examiner

*Primary Examiner*—Edward K. Look
*Assistant Examiner*—Dwayne J White
(74) *Attorney, Agent, or Firm*—Kenneth C. Baran

(57) ABSTRACT

Rotor blades 40 for a bladed rotor feature an attachment 44 that improves the energy absorption capability of a snap ring 60 used as one component of a blade axial retention system. The attachment plastically deforms the snap ring rather than shearing through it in response to abnormally high forces exerted on the blade.

2 Claims, 8 Drawing Sheets

FIG.7
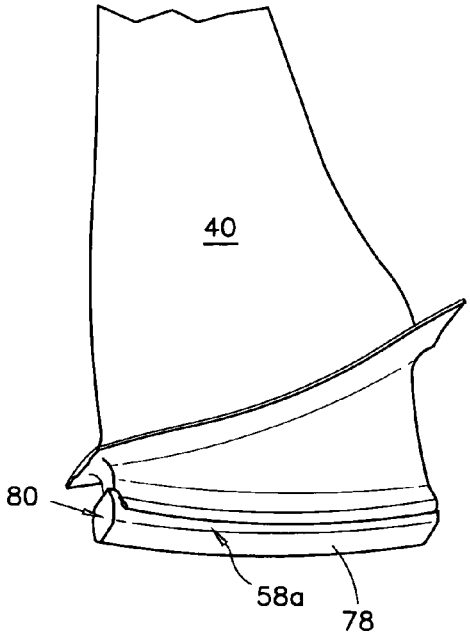
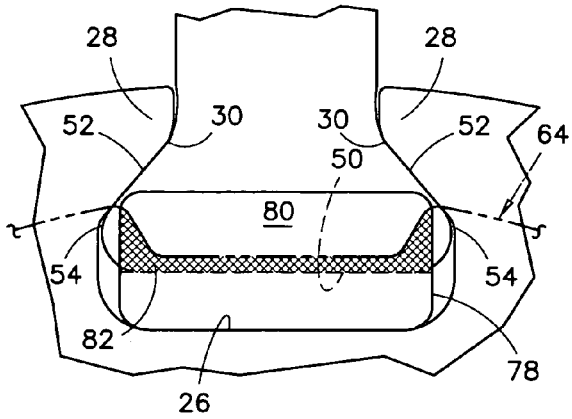
FIG.9
FIG.8
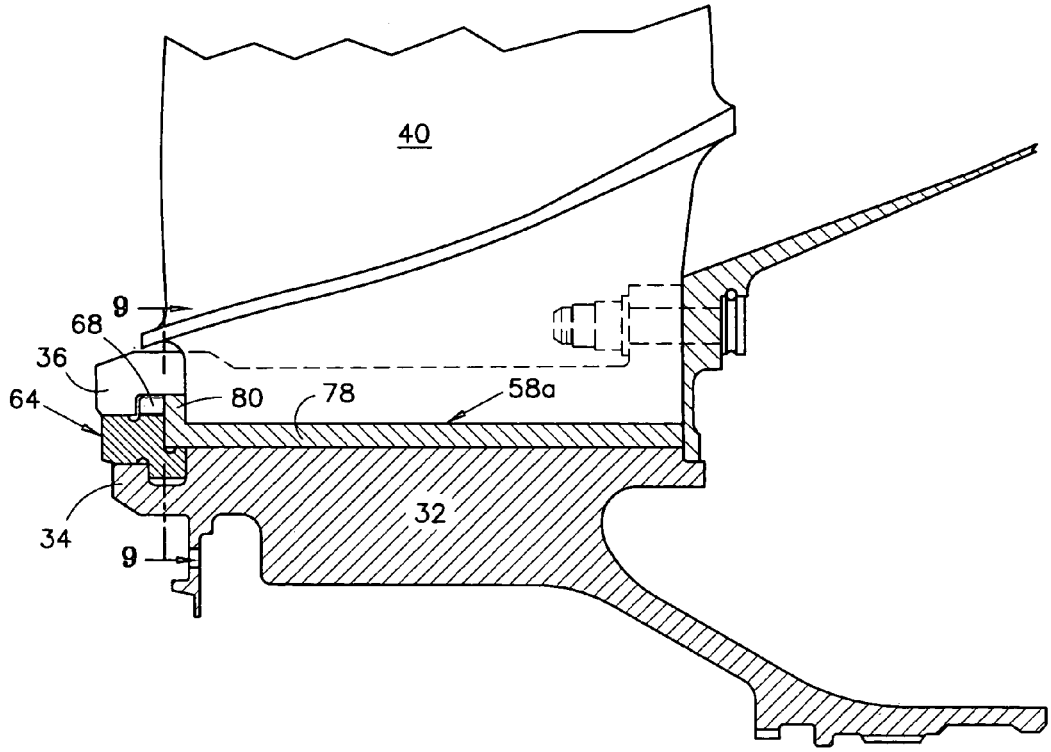

FIG.10
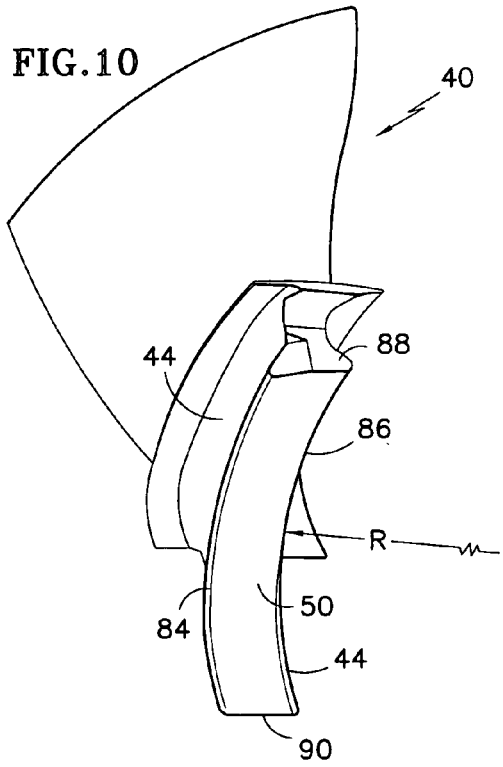
FIG.11
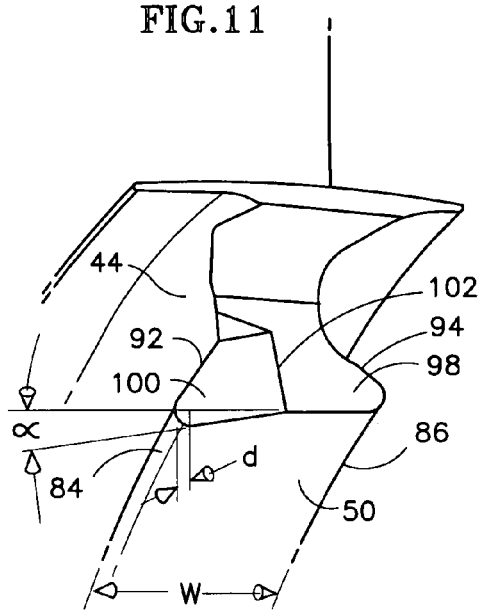
FIG.12
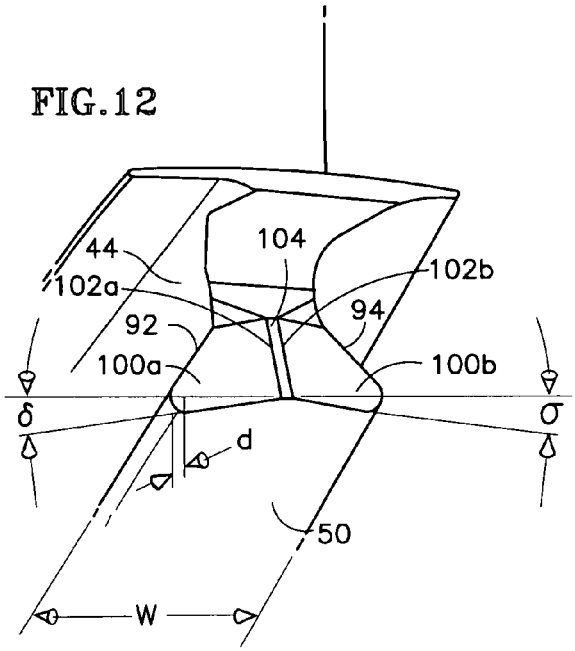
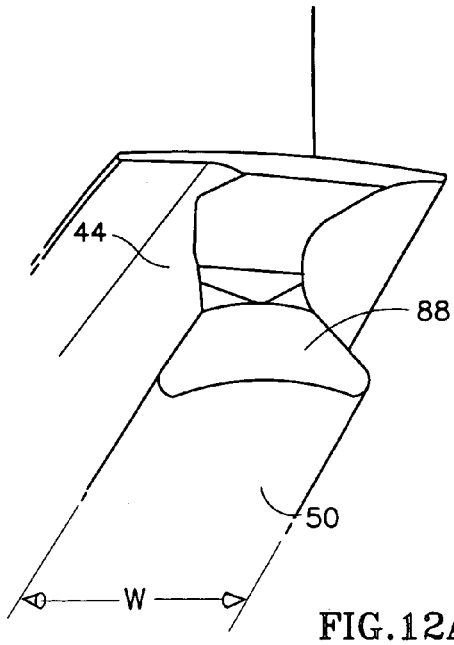
FIG.12A

ATTACHMENT FOR A BLADED ROTOR

This is a continuation of commonly owned, co-pending application Ser. No. 10/123,453 filed on Apr. 16, 2002.

CROSS REFERENCE TO RELATED APPLICATIONS

This application includes subject matter in common with commonly owned applications entitled "Axial Retention System and Components thereof for a Bladed Rotor", Ser. No. 10/123,451 and "Bladed Rotor with a Tiered Blade to Hub Interface", Ser. No. 10/123,549.

TECHNICAL FIELD

This invention relates to an axial retention system and components thereof for a bladed rotor, particularly a fan rotor of a gas turbine engine.

BACKGROUND OF THE INVENTION

A fan rotor of the type used in an aircraft gas turbine engine includes a hub capable of rotating about a rotational axis and an array of blades extending radially from the hub. The hub includes a series of circumferentially distributed peripheral slots. Each slot extends in an axial or predominantly axial direction and has a pair of overhanging lugs, each with an inwardly facing bearing surface. When viewed in the radial direction, each slot may be linear, with the slot centerline oriented either parallel or oblique to the rotational axis, or may have a curved centerline and a corresponding curved shape. Each slot is typically open at either the forward end of the hub, the aft end of the hub, or both to facilitate installation and removal of the blades.

Each blade includes an attachment feature that occupies one of the slots and an airfoil that projects radially beyond the hub periphery. Bearing surfaces on the flanks of the attachment contact the bearing surfaces of the slot lugs to trap the blade radially in the hub. An axial retention system prevents the installed blades from migrating axially out of the slots.

During operation of the engine, the fully assembled bladed rotor rotates about its rotational axis. Each blade is followed by one of its two adjacent neighbors and is led by its other adjacent neighbor in the direction of rotation. Accordingly, each blade in the blade array is said to have a following neighbor and a leading neighbor.

During operation, a blade fragment can separate from the rest of the blade. A separation event usually results from foreign object ingestion or fatigue failure. Because the separated blade fragment can comprise a substantial portion of the entire blade, separation events are potentially hazardous and, although rare, must be safely accounted for in the design of the engine. Engine designers have devised numerous ways to safely tolerate the separation of a single blade. However it has proven inordinately difficult to accommodate the separation of two or more blades without introducing excessive weight, cost or complexity into the engine. Accordingly, it is important that the separation of one blade not provoke the separation of additional blades.

A separated blade can cause the separation of its following neighbor if the initially separated blade contacts the airfoil of the following blade. The following blade urges the initially separated blade aftwardly and, in doing so, experiences a forwardly directed reaction force. The reaction force can overwhelm the axial retention system that normally traps the following blade axially in its hub slot, thereby ejecting the blade from the slot. Accordingly, it is important that the axial retention system be able to withstand such an event.

Another desirable feature of an aircraft engine fan rotor is resistance to windmilling induced wear. Windmilling is a condition that occurs when an aircraft crew shuts down a malfunctioning or damaged engine in flight. The continued forward motion of the aircraft forces ambient air through the fan blade array causing the fan rotor to slowly rotate or "windmill". Windmilling also occurs when wind blows through the engine of a parked aircraft. Windmilling rotational speeds are too slow to urge the blade attachment flanks centrifugally against the disk slot lugs. As a result, the blade attachments repeatedly chafe against the surfaces of the hub slots causing accelerated wear of the blade attachments and the hub. Since both the hub and blades are extremely expensive, accelerated wear is unacceptable to the engine owner.

Accelerated attachment and hub wear can be mitigated by ensuring a snug fit between the blade attachment and the hub slot. Alternatively, the attachment can be radially undersized relative to the slot with the size difference being taken up by a tightly fitting spacer that occupies the hub slot radially inboard of the blade attachment. Either way, excessive tightness complicates blade installation and removal. Moreover, surfaces that slide relative to each other during blade installation or removal are susceptible to damage from abrasive contaminants that might be present on the surfaces. Excessive tightness exacerbates the risk of damage. Accordingly, it is important not only to ensure a snug fit, but also to minimize the risk of damaging to expensive components during blade installation and removal.

SUMMARY OF THE INVENTION

It is, therefore, an object of the invention to provide an improved axial retention system for a bladed rotor, such as a turbine engine fan rotor.

It is an additional object to minimize windmilling induced damage and to ensure that the blades are easily installable and removable without excessive risk of damage According to the invention, an axial retention system for a bladed rotor includes a hub with bayonet hooks, a bayonet ring with bayonet projections that engage the hooks, and a load transfer element that occupies an annulus defined by the hooks. Ideally, the load transfer element is a substantially circumferentially continuous snap ring. If a separation event or other abnormality exerts an excessive axial load on a blade, the snap ring safely distributes that load to the bayonet hooks to prevent the blade from severing the snap ring and being ejected axially from its slot. The rotor blades themselves feature a chamfered attachment that improves the energy absorption capability of the snap ring. The interface between each blade and its respective slot is tiered. Ideally the interface is a tiered spacer that occupies the hub slot radially inboard of the blade attachment. The spacer ensures a tight fit to resist windmilling induced wear. The tiered character of the spacer reduces the risk of damage during blade installation and removal. The spacer also helps to transmit axial loads to the snap ring during a blade separation event.

The principal advantage of the invention is its ability to prevent the separation of multiple blades. A further advantage is the ability of the tiered spacer to prevent or minimize damage to the hub and blades during windmilling and during blade installation and removal.

BRIEF DESCRIPTION OF THE DRAWINGS

FIG. 7 is a perspective view of a fan blade and a flanged spacer used in an alternate embodiment of the invention.

FIG. 8 is a cross sectional side elevation view similar to that of FIG. 4 showing the alternate embodiment of the invention using the flanged spacer of FIG. 7.

FIG. 9 is a view in the direction 9—9 of FIG. 8 showing a typical hub slot and blade attachment along with the spacer of FIG. 7.

FIG. 10 is a perspective view of a fan blade showing a curved attachment with a chamfer on its proximal end.

FIG. 11 is an enlarged view, similar to FIG. 10.

FIG. 12 is an enlarged view similar to FIG. 11, but showing a blade with a linear attachment and a pair of chamfers.

FIG. 12A is a view similar to FIG. 12, but showing a blade with a rounded proximal end.

BEST MODE FOR CARRYING OUT THE INVENTION

Figure 1:
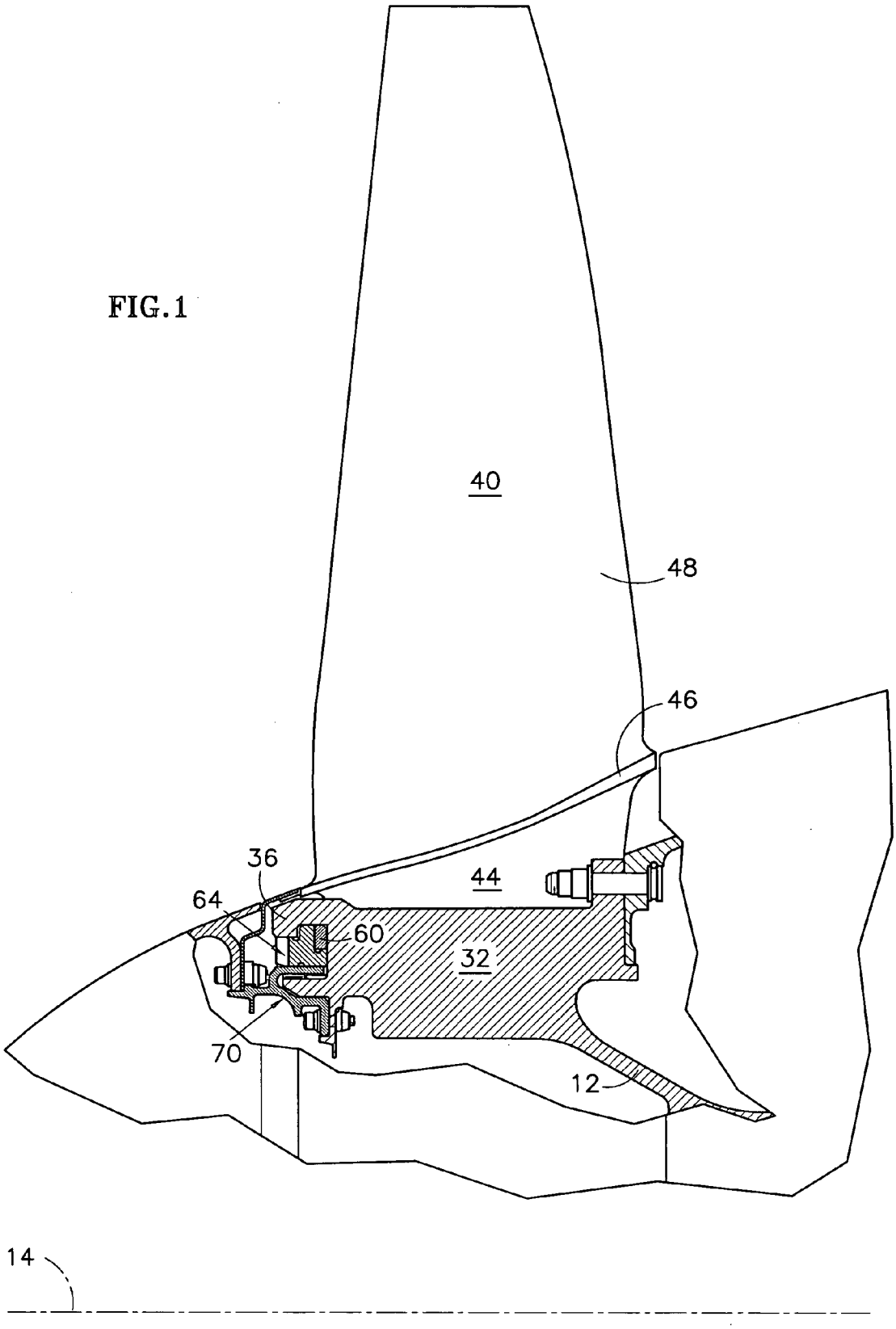
FIG. 1 is a cross sectional side elevation view of an aircraft gas turbine engine fan rotor showing the principal features of the inventive axial retention system, the plane of the view being circumferentially offset from a blade receiving slot in the rotor hub.
Figure 2:
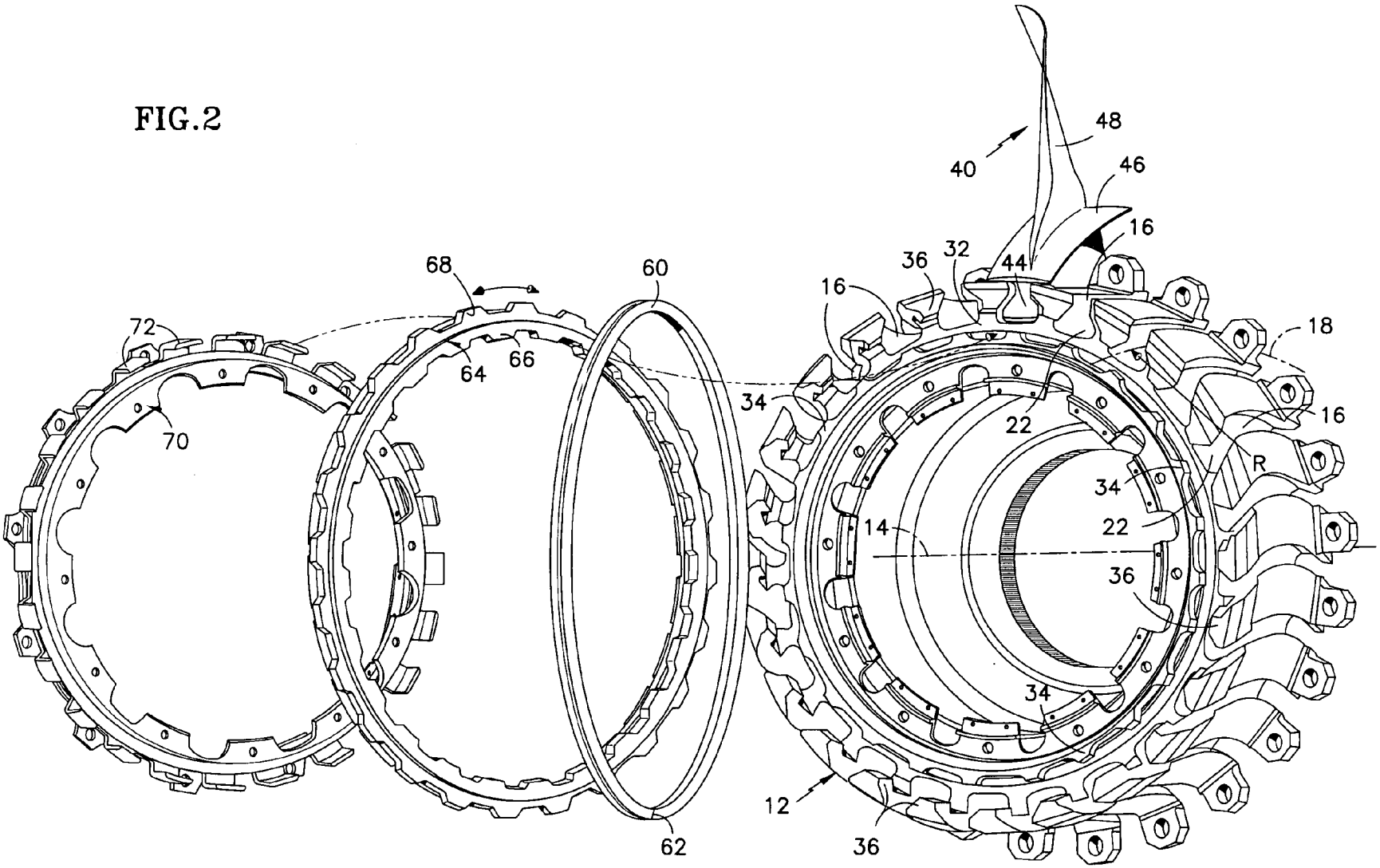
FIG. 2 is an exploded perspective view of the principal elements of the inventive axial retention system.

Referring principally to FIGS. 1 and 2, a fan rotor of an aircraft gas turbine engine includes a hub 12 rotatable about a rotational axis 14. The hub includes a series of circumferentially distributed peripheral slots 16. The illustrated slots, when viewed by an observer looking radially toward the axis, have a curved centerline 18 and a correspondingly curved profile. The centerline has a radius of curvature R. Alternatively, the slots may be linear slots having a linear centerline oriented parallel or oblique to the rotational axis. A slot opening 22 at the forward end of the hub, the aft end of the hub or both accommodates installation or removal of fan blades, described below, in the axial direction. As used throughout this specification, the term "axial" refers not only to a direction strictly parallel to the rotational axis but also to directions somewhat non-parallel to the axis, such as the slotwise direction defined by a curved or linear slot. As seen best in FIG. 9, each slot is bounded radially by a floor 26 and a pair of overhanging lugs 28 with inwardly facing bearing surfaces 30.

Figure 3:
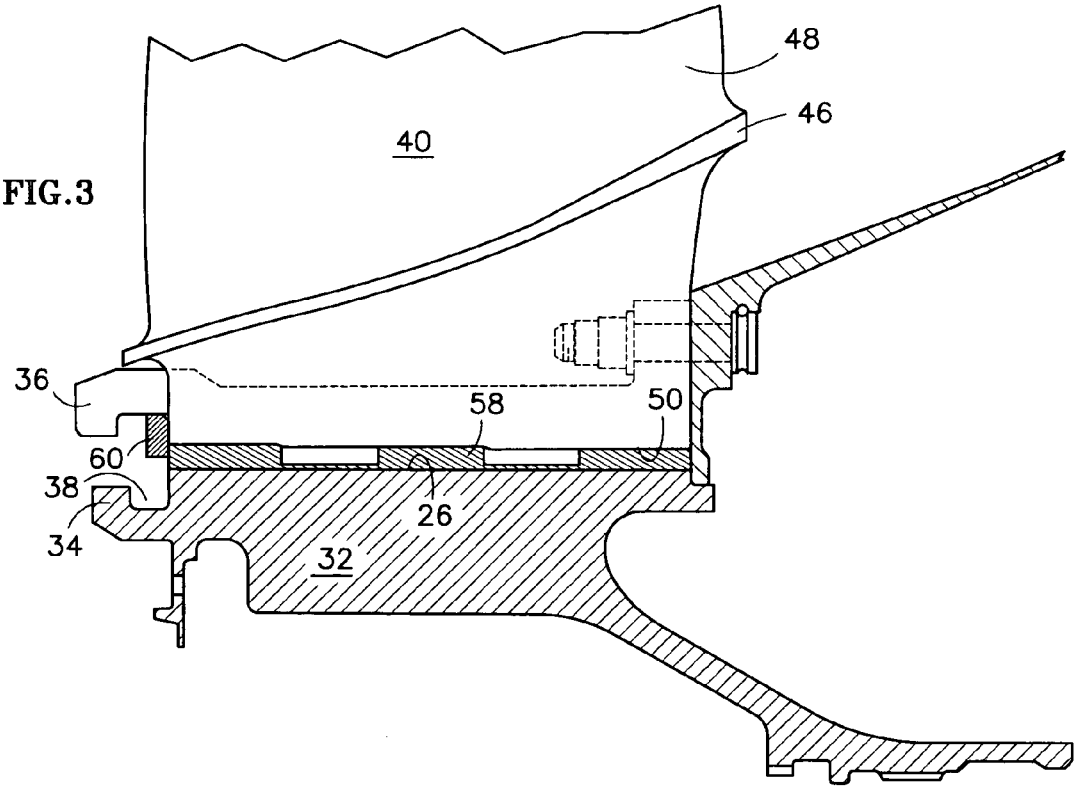
FIG. 3 is an enlarged view similar to that of FIG. 1, but taken in the plane of a hub slot, showing the inventive axial retention system in an early state of assembly.

Referring additionally to FIG. 3, the hub comprises a main body 32 with radially inner and outer bayonet hooks, 34, 36 projecting axially from the main body. The inner and outer hooks are circumferentially offset from each other and cooperate with the main body 32 of the hub to define an annulus 38.

The fan rotor also includes an array of fan blades such as representative blade 40. Each fan blade comprises an attachment 44, a platform 46 and an airfoil 48, although some rotors employ platforms non-integral with the blades. The attachment has a base surface 50. The attachment is curved or linear to match the shape of the hub slots. In an assembled rotor, and as seen most clearly in FIG. 9, the attachment 44 of each blade occupies one of the hub slots. Bearing surfaces 52 on the flanks 54 of each attachment cooperate with the lug bearing surfaces 30 to radially trap the blade.

Figure 4:
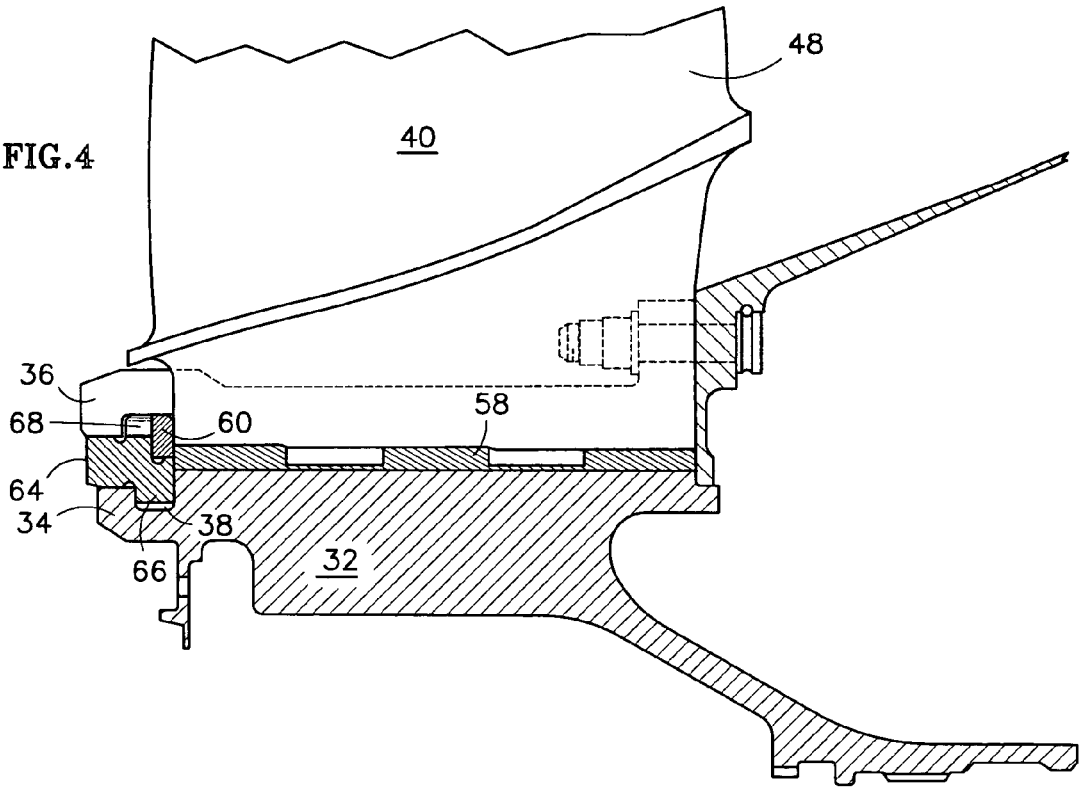
FIG. 4 is an enlarged view similar to that of FIG. 3 showing the inventive axial retention system in an intermediate state of assembly.

Referring principally to FIGS. 3 and 4, a spacer 58 occupies each hub slot radially intermediate the blade attachment and the slot floor. The spacer, which is described in more detail below, is a relatively inexpensive component that urges the lug and attachment bearing surfaces 30, 52 (FIG. 9) radially into contact, or at least into close proximity with each other. By doing so, the spacer limits the proclivity of the attachments to chafe against the hub at low rotational speeds and thus resists windmilling induced damage to the costly blades and hub. In principle, the attachment could be made radially large enough to occupy substantially the entire hub slot, rendering the spacer unnecessary. However, use of a spacer in combination with a radially undersized attachment has certain advantages. For example, during assembly of the rotor the radially undersized blade attachment may be translated effortlessly into the hub slot, followed by insertion of the spacer. To the extent that it may be necessary to exert force on the hardware to complete the assembly, the force can be exerted on the inexpensive spacer, not on the fan blade itself. This reduces the risk of damaging the expensive blade, particularly if the exerted force is an impact force.

A load transfer element occupies the annulus 38 adjacent the blade attachments. The preferred load transfer element is a snap ring 60. The snap ring is circumferentially continuous except for a split 62 (FIG. 2) that enables a technician to deflect the snap ring enough to maneuver it into the annulus.

Referring principally to FIGS. 1, 2 and 4, a bayonet ring 64 also occupies the annulus 38. The bayonet ring features radially inner and outer bayonet projections 66, 68. The bayonet projections, like the bayonet hooks 34, 36 on the hub, are circumferentially offset from each other. During assembly operations, a technician orients the bayonet ring so that its inner and outer projections 66, 68 are circumferentially misaligned with the inner and outer hooks 34, 36. The technician then translates the ring axially into the annulus 38. Finally, the technician rotates the ring until the inner and outer projections 66, 68 lie axially aft of and engage the inner and outer bayonet hooks. Engagement of the bayonet projections with the bayonet hooks retains the bayonet ring axially. Because the ring fits tightly into the annulus 38 aft of the hooks, a recess or functionally similar feature may be provided on the ring so that the technician can employ a drift or similar tool to rotate the ring into position.

Figure 5:
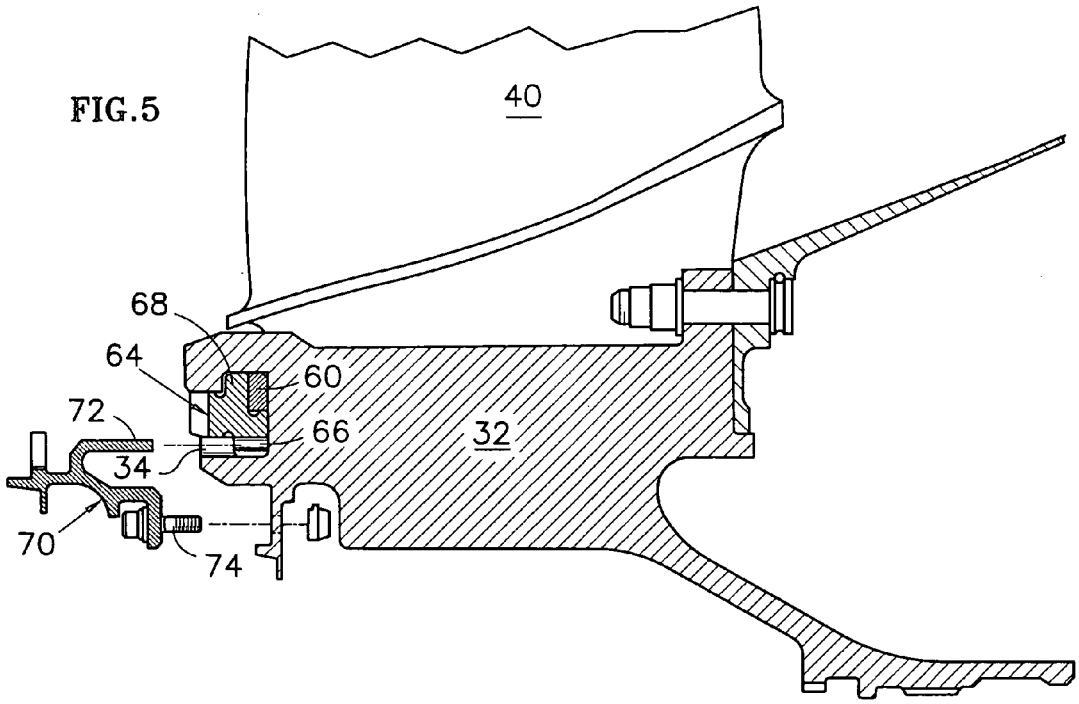
FIG. 5 is an enlarged view similar to that of FIG. 4, but taken in a plane circumferentially intermediate two hub slots, showing the inventive axial retention system in a nearly final state of assembly.
Figure 6:
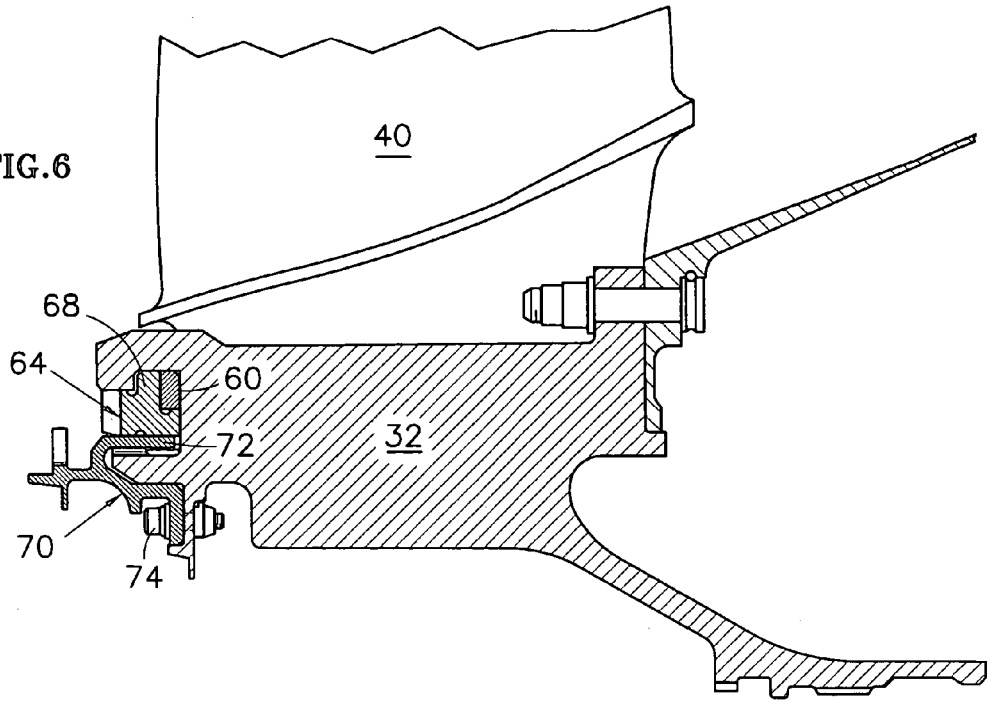
FIG. 6 is an enlarged view similar to that of FIG. 5 showing the inventive axial retention system in a complete state of assembly.

Referring principally to FIGS. 1, 5 and 6, a lock resists rotation of the bayonet ring 64 relative to the hub. The preferred lock is a retainer ring 70 with a plurality of tabs 72. Bolts 74 secure the retainer ring to the hub with each tab projecting axially into a space between circumferentially adjacent inner bayonet projections 66. The tabs resist forces that act to rotate the bayonet ring projections 66, 68 out of engagement with the bayonet hooks 34, 36. The tabs also help to center the bayonet ring to ensure proper rotor balance.

During operation, a fan blade may be exposed to forces tending to drive the blade axially out of its slot. Among the most challenging forces are those exerted on a blade that rotationally follows a separated blade. When the separated blade strikes the following blade, the following blade experiences a reaction force that urges it, and its associated spacer 58, axially against snap ring 60. The snap ring transfers this ejection force to the bayonet ring which, in turn, distributes the force amongst several of the bayonet hooks. For a blade with a curved attachment, most of the force is believed to be distributed amongst five of the hooks—the two outer hooks immediately adjacent the hub slot, the inner hook radially inboard of the slot and, to a lesser extent, the hooks on either side of that inner hook.

Referring to FIGS. 7–9, a flange on a spacer 58*a* serves as the load transfer element in an alternate embodiment of the invention. The flanged spacer has a base 78 and a flange 80. The spacer base, like the simple spacer of the preferred embodiment, occupies the hub slot radially intermediate the attachment 44 and the slot floor 26. The flange 80 resides in the annulus 38 and projects radially so that the flange is adjacent the front end of the blade attachment. In another alternative embodiment, the spacer flange resides in the slot itself. However this arrangement may be unattractive because it requires a corresponding recess on the front side of the attachment to accommodate the flange. The recess will increase the complexity and cost of manufacture and may compromise the structural integrity of the blade.

In operation, if a blade experiences a force that attempts to drive it out of its slot, the blade attachment transfers that force to the spacer flange which then transfers the force to the bayonet ring 64. As with the preferred embodiment, the bayonet ring then distributes the force amongst the bayonet hooks. As seen best in FIG. 9, which shows the profile of the bayonet ring 64 in phantom, the region of coincidence 82 (depicted with cross hatch lines) of the attachment, the spacer flange and the bayonet ring is relatively small. As a result, the blade may be able to penetrate through the bayonet ring 64. Therefore, the flanged spacer is thought to be most suitable for applications where the ejection force is modest.

FIGS. 10 and 11 illustrate a fan blade 40 configured to improve the energy absorption capability of the snap ring 60. The blade has a curved attachment 44 extending laterally from a convex flank 84 to a concave flank 86. The lateral width of the attachment is W. The attachment also extends from a proximal end 88 to a distal end 90, the proximal end being the end intended to be proximate the load transfer element. The juncture between the proximal end and the convex flank may be referred to as the convex edge 92. Similarly, the juncture between the proximal end and the concave flank may be referred to as the concave edge 94. The proximal end includes a conventionally oriented surface 98 that parallels the front end of the hub when the blade is installed in a hub slot. In other words, conventional surface 98 lies in a plane perpendicular to rotational axis 14. The proximal end also includes a chamfer feature. The illustrated chamfer feature is a single chamfer 100 that extends laterally from the conventional surface and whose lateral extent is less than the lateral width W of the attachment. The chamfer has a maximum depth d and a chamfer angle $\alpha$ measured in a plane parallel to the attachment base surface 50. The conventional surface and the chamfer meet at a ridge 102.

The advantage of the chamfered proximal end is best appreciated by first examining the behavior of a conventional proximal end, i.e. one with a conventional surface extending substantially the entire lateral width W. If a force attempts to eject such a blade axially from its slot, the proximal end exposes the snap ring to a double shear mode of energy transfer. The double shear mode can cause the lateral edges of the blade attachment to shear through the snap ring.

Figure 13:
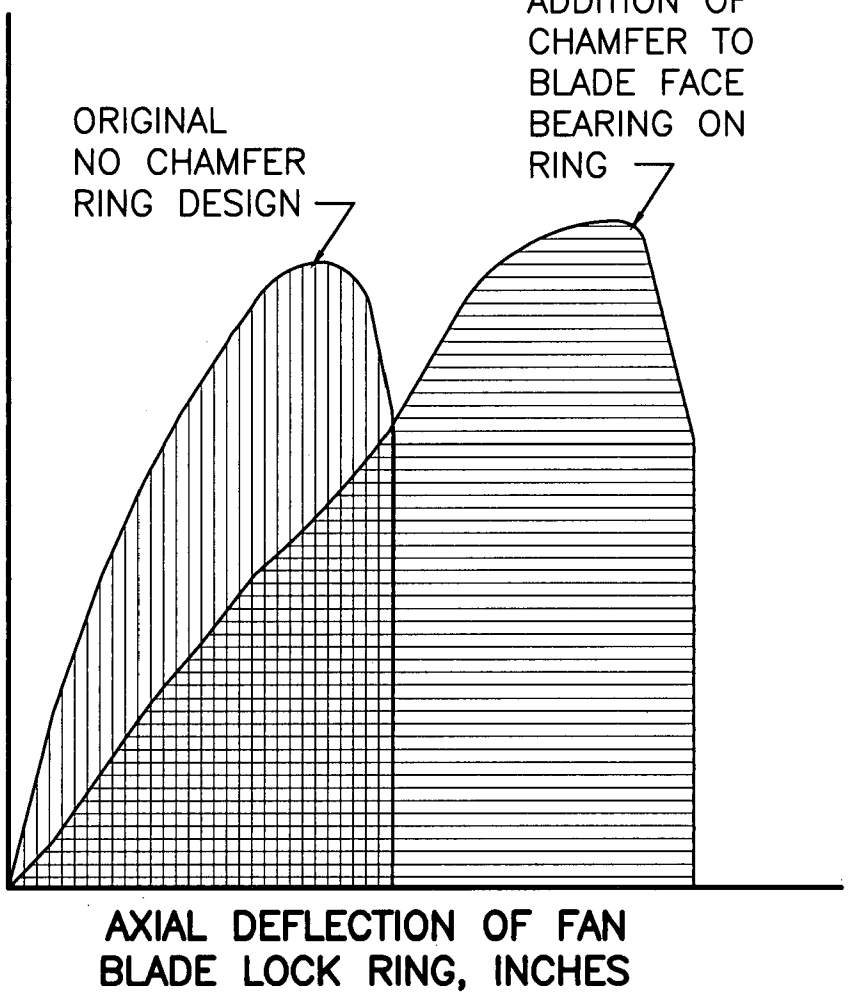
FIG. 13 is a graph comparing the load transmission behavior of the rotor blade of FIGS. 10 and 11 with that of a conventional rotor blade.

By contrast, the chamfered proximal end plastically deforms the snap ring, with the maximum deformation occurring approximately where the ridge 102 contacts the snap ring. The chamfered proximal end bends the snap ring rather than shearing through it. The difference in energy absorption capacity is evident as the area under a graph of snap ring load vs. snap ring deflection. FIG. 13 shows such a graph based on experimental testing.

In the preferred embodiment, the chamfer extends laterally from the ridge to the convex edge whereas the conventional surface extends laterally from the ridge to the concave edge. This polarity is believed to be beneficial because of the path followed by a curved attachment when urged axially against the snap ring by excessive forces. As the blade travels along the curved profile of its slot, its convex edge 92 is likely to emerge from the hub slot opening 22 earlier than its concave edge 94. Placing the chamfer closer to the convex flank 84, and remote from the concave flank, delays the emergence of the convex edge 92, allowing the ridge 102 to provoke the onset of bending in the snap ring. After the snap ring begins to bend, the chamfered surface 100 then contacts the snap ring to distribute the ejection force.

The chamfer angle $\alpha$ is selected to increase the energy absorption capacity of the snap ring and is a function of at least the radius of curvature R of the slot (which is also the radius of curvature of the attachment) and is inversely related thereto. That is, an attachment with a smaller radius of curvature requires a larger chamfer angle than does an attachment with a smaller radius of curvature to ensure delayed emergence of the convex edge. However, an excessively large chamfer angle can cause undesirable force concentration by preventing full contact between the chamfer 100 and the snap ring 60 subsequent to initial deformation of the ring. Conversely, if the chamfer angle is too small, the proximal surface approximates a completely conventional, unchamfered surface, resulting in little or no benefit. In an engine manufactured by the assignee of the present application, the slot radius of curvature is about 9.0 inches (about 22.9 centimeters) and the chamfer angle is about 10 degrees.

In principle, the chamfer may extend substantially the entire lateral width W of the attachment so that the conventional surface 98 is absent. However the conventional surface has value as a machining datum and so its presence is desirable to facilitate accurate blade manufacture.

Referring to FIG. 12, the chamfer feature is also useful for blades having linear attachments with substantially parallel flanks intended to be received in linear hub slots. Such slots may be parallel to the rotational axis 14 or may be angularly offset from the axis by a prescribed slot angle. When the chamfer feature is used on a linear attachment, it is recommended that two chamfers 100*a*, 100*b* be used, one proximate each flank. Each chamfer has a respective chamfer angle $\delta$, $\sigma$. The chamfer angles are ordinarily equal to each other. Although the chamfers 100*a*, 100*b* can meet at a single ridge, it is desirable to provide a nose section 104 in a plane parallel to the rotational axis. The nose 104 has value as a machining datum. The juncture between the nose and each chamfer is a ridge 102*a*, 102*b*. A double chamfer as seen in FIG. 12 is preferred for a linear attachment because both flanks of the attachment are expected to emerge from the linear slot substantially simultaneously. As a result, the nose contacts the snap ring 60 at a location circumferentially offset from the outer bayonet hooks 36, thereby reducing any tendency of the attachment to shear through the snap ring and increasing the tendency of the attachment to plastically deform the snap ring. The chamfer angles δ, σ are selected to increase the energy absorption capacity of the snap ring.

It may also be desirable to employ a double chamfer on a curved attachment—one chamfer extending laterally from the ridge toward the convex edge and the other extending laterally from the ridge toward the concave edge. In the limit, and as seen in FIG. 12A, the proximal end of either a curved or a linear attachment may have a rounded or curved profile, such as an ellipse.

Figure 14:
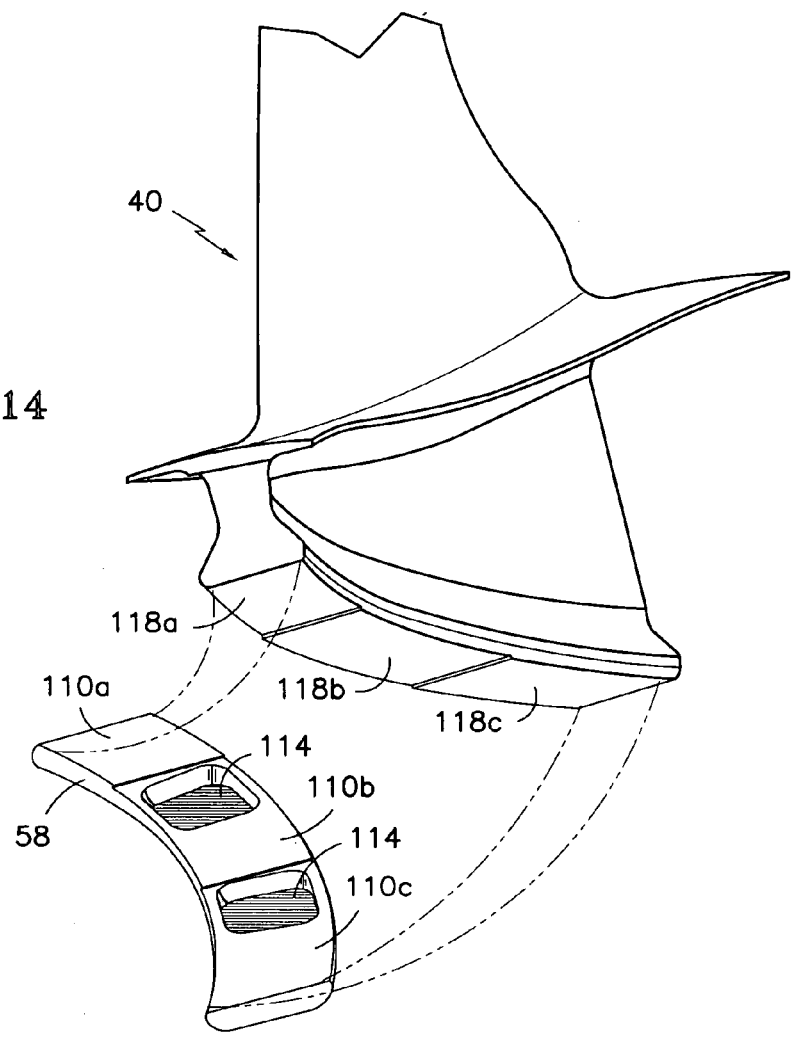
FIG. 14 is a perspective view showing a fan blade and a spacer, each having a tiered surface.
Figure 15:
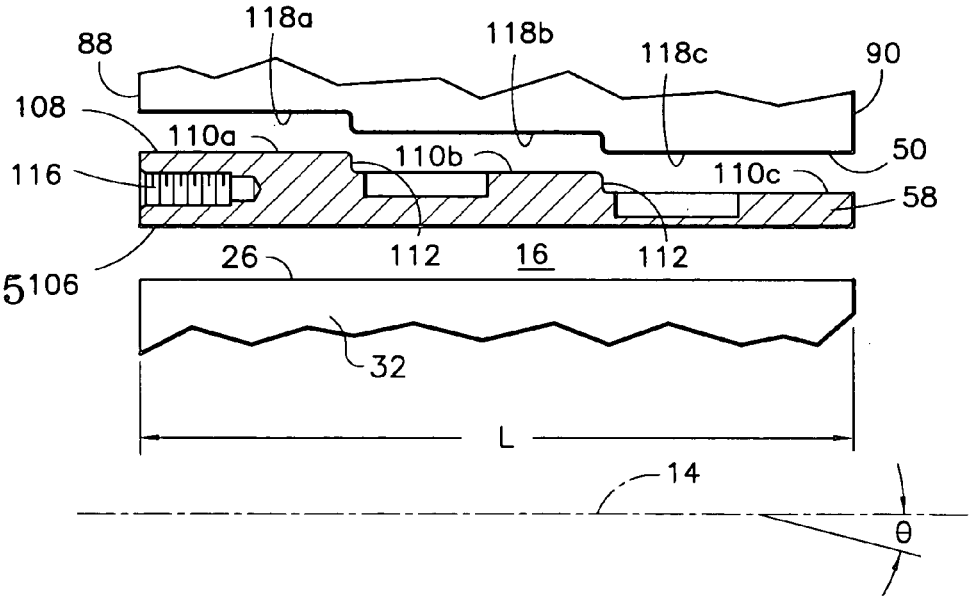
FIG. 15 is a cross sectional side elevation view, slightly exploded in the radial direction, showing the tiered features of FIG. 14.

Referring now to FIGS. 14 and 15, a bladed rotor according to the present invention includes a tiered interface between the fan blade 40 and its respective hub slot 16. As seen in FIG. 15, which is slightly exploded in the radial direction, the tiered interface comprises spacer 58 having an inner contact surface 106 that faces the slot floor 26 and an outer contact surface 108 that faces the attachment base surface 50. The outer contact surface 108 has a set of three tiers or steps 110*a*, 110*b*, 110*c*. A riser 112 between neighboring steps may be of any convenient form such as a chamfer or fillet. Pockets 114 centered on two of the steps impart some flexibility to the spacer. If desired, the pockets may be overfilled with a suitable compressible material to ensure that the spacer fits tightly in the space radially inboard of the attachment. A threaded opening 116 accommodates a threaded tool, not shown, so that an installed spacer may be easily extracted from the slot. The tiered interface also comprises a set of three mating steps 118*a*, 118*b*, 118*c* on the attachment base surface.

The spacer occupies the hub slot 16 to urge the blade attachment bearing surfaces 52 radially outwardly against the bearing surfaces 30 on the hub lugs as seen best in FIG. 9. This is especially important at very low rotational speeds to prevent the attachment from chafing against the slot and causing damage to the hub, the attachment or both.

The advantage of the tiered configuration is best appreciated by first considering a more conventional flat spacer. When a technician inserts a flat spacer into the slot 16, its inner and outer contact surfaces slide along the attachment base surface and the hub floor throughout the entire length L of the slot. As a result, any abrasive contaminants present on the surfaces can scratch the attachment or hub. Scratches are of concern, particularly on the hub, because they represent potential crack initiation sites. Since the hub is highly stressed during engine operation, it is desirable to minimize the quantity and extent of scratches, thus minimizing the need for periodic inspection and/or precautionary replacement of these expensive components.

The tiered spacer reduces the potential for scratching because the mating steps slide against each other over only a fraction of the slot length L during spacer installation. For example, with the illustrated three tiered spacer, no appreciable detrimental sliding contact occurs until the spacer has completed two thirds of its travel into the slot. Sliding contact is thus limited to the remaining one third of the travel. If desired, an antifriction coating may be applied to one or more of the contacting surfaces 26, 50, 106, 108.

Manufacturing considerations and load bearing capability help to govern the quantity of steps. Each riser 112 consumes a small but finite amount of the axial length L. If opposing risers on the attachment base surface and spacer outer contact surface fail to conform precisely to each other because of manufacturing inaccuracies, the risers won't bear their proportionate share of the operational loads and will therefore cause the steps themselves to be more heavily loaded. Increasing the quantity of steps and risers only exacerbates the effect. Moreover, installation of each step requires the manufacturer to adhere to exacting manufacturing tolerances. Adhering to these tolerances increases the cost of manufacture. Failure to adhere to the tolerance requirements will cause some mating steps to be in more intimate contact than other mating steps. The steps in intimate contact will be more heavily loaded during engine operation and the other steps more lightly loaded. Accordingly, the quantity of steps is governed by the competing considerations of preventing installation related damage without adding manufacturing cost or maldistributing the operational loads.

In an alternative embodiment, the tiered interface comprises a spacer having steps or tiers on its inner contact surface 106 and a hub having mating steps on the slot floor 26. In another alternative, the steps are present on all four surfaces—the inner and outer contact surfaces 106, 108, the slot floor 26 and the attachment base surface 50. These alternate embodiments suffer from the disadvantage that they involve the presence of tiers on the hub. The tiered surfaces can introduce stress concentrations that may not be acceptable on the highly stressed hub. Moreover, any manufacturing errors committed while installing the tiers might render the hub unsuitable for service despite the considerable expense already invested in its manufacture.

The illustrated tiers parallel the rotational axis 14, however each tier may be a ramped at a prescribed ramp angle θ relative to the axis. Ramped steps can all but eliminate the potential for scratching because no contact occurs until the spacer is fully inserted into the hub slot. However the ramps may be difficult and expensive to manufacture, especially if the spacer, blade and slot are curved rather than linear.

Although this invention has been shown and described with reference to a detailed embodiment thereof, it will be understood by those skilled in the art that various changes in form and detail may be made without departing from the invention as set forth in the accompanying claims. For example, even though the invention has been presented in the context of a turbine engine fan rotor, its applicability extends to other types of bladed rotors as well.

I claim:

1. A blade for a bladed rotor, the blade having an attachment receivable in a slot of a rotor hub, the hub having a rotational axis and a series of slots defining a slotwise direction, the attachment having proximal and distal ends, the proximal end being an end intended to be proximate a load transfer element when the blade is received in the slot, the proximal end also being rounded as viewed by an observer looking radially toward the rotational axis.

2. A bladed rotor, comprising:

a hub having a main body with peripheral slots defining a slotwise direction; and a plurality of blades each having an attachment occupying one of the slots, each attachment extending in the slotwise direction from a proximal end to a distal end, the proximal end being an end proximate a load transfer element, the proximal end of each blade attachment being rounded as viewed by an observer looking radially toward a rotational axis of the hub.

* * * * *